US006076385A

United States Patent [19]

Pedroso et al.

[11] Patent Number: 6,076,385

[45] Date of Patent: Jun. 20, 2000

[54] SECURITY DOOR LOCK WITH REMOTE CONTROL

[75] Inventors: Paul L. Pedroso; Duarte M. Oliveira, both of Lowell, Mass.

[73] Assignee: Innovative Industries, Corporation, Lowell, Mass.

[21] Appl. No.: 09/129,648

[22] Filed: Aug. 5, 1998

[51] Int. Cl.[7] ..... E05B 47/02

[52] U.S. Cl. ..... 70/257; 70/277; 70/278.6; 70/280; 292/144; 292/162; 292/DIG. 51

[58] Field of Search ..... 292/144, 162, 292/DIG. 51; 70/277, 278.6, 278.7, 280–282, 256, 257

[56] References Cited

U.S. PATENT DOCUMENTS

| | | | |
|---|---|---|---|
| 518,667 | 4/1894 | Eldon | 292/144 |
| 608,321 | 8/1898 | Carleton | 292/144 |
| 804,040 | 11/1905 | Platt | 292/144 X |
| 3,520,567 | 7/1970 | Van Gilst | 292/162 X |
| 3,820,284 | 6/1974 | Boughton | 292/144 X |
| 4,212,489 | 7/1980 | Snyder | 292/144 X |
| 4,218,681 | 8/1980 | Hörmann | 455/603 |
| 4,355,399 | 10/1982 | Timor | 375/1 |
| 4,519,640 | 5/1985 | Mombelli | 292/144 X |
| 4,573,046 | 2/1986 | Pinnow | 340/825.56 |
| 4,659,121 | 4/1987 | McGee | 292/144 |
| 4,683,733 | 8/1987 | Marin | 70/379 R X |
| 4,770,012 | 9/1988 | Johansson et al. | 70/278 |
| 4,794,268 | 12/1988 | Nakano et al. | 307/10 AT |
| 4,802,353 | 2/1989 | Corder et al. | 70/277 |
| 4,820,330 | 4/1989 | Lin | 70/277 |
| 4,877,275 | 10/1989 | DeForrest, Sr. | 292/162 X |
| 4,970,494 | 11/1990 | Keely et al. | 340/567 |
| 5,261,260 | 11/1993 | Lin | 292/144 X |
| 5,525,973 | 6/1996 | Andreou et al. | 340/825.31 |
| 5,531,086 | 7/1996 | Bryant | 292/144 X |
| 5,626,039 | 5/1997 | Solari et al. | 292/144 X |
| 5,646,605 | 7/1997 | Leonaggeo et al. | 340/825.31 |
| 5,650,774 | 7/1997 | Drori | 340/825.32 |
| 5,712,626 | 1/1998 | Andreou et al. | 340/825.31 |

FOREIGN PATENT DOCUMENTS

| | | | |
|---|---|---|---|
| 852847 | 3/1940 | France | 292/144 |
| 1155415 | 4/1958 | France | 292/144 |
| 2667105 | 3/1992 | France | 292/144 |
| 9571 | 2/1907 | United Kingdom | 292/144 |

*Primary Examiner*—Lloyd A. Gall
*Attorney, Agent, or Firm*—Pearson & Pearson

[57] ABSTRACT

An electrically operated, strong, security system comprising a lock with remote control installed in a wall adjacent to a door frame. The lock comprises rods which extend into the door when the door is closed and in a locked state. In an unlocked state an actuator retracts the rods from the door, back into the door frame. The security lock system provides a manual control for the lock inside a house or building along with indicator lights showing the lock status. An emergency DC battery provides power for the security lock if there is a primary power outage. A remote control locks all doors in the house simultaneous that have such a security lock, and the remote control unlocks only the door or doors selected to be unlocked.

18 Claims, 6 Drawing Sheets

SECURITY DOOR LOCK WITH REMOTE CONTROL

BACKGROUND OF THE INVENTION

1. Field of the Invention

This invention relates to an electrically powered door lock system and in particular to a remote controlled security door lock for installation in a wall adjacent to a door and capable of remote control operation.

2. Description of Related Art

Keyless door locks in a house or building provide a user with considerable convenience especially when the users hands are full carrying items.

U. S. Pat. No. 4,802,353 issued Feb. 7, 1989 to Corder et al discloses a battery-powered electromechanical door-lock assembly which is keyless. A bolt assembly includes electromagnetic means responsive to an input signal for energization and positioned to hold the locking assembly in the unlocked position upon energization thereof to prevent moving of the locking assembly to the locked position upon movement of the handle. The locking assembly comprises a control housing on the interior of the door including digital circuitry for the lock powered by batteries.

U.S. Pat. No. 5,525,973 issued Jun. 11, 1995 to Andreou et al discloses a remotely-operated self contained electronic lock security system. A remote hand held controller transmits coded signals to an electronic door lock. The lock is sized and configured to be utilized with a conventional doorlatch lock mechanism. For example, the mechanical "locking" portion of the apparatus and optical or radio frequency sensor is preferably constructed so as to be installable within the exterior handle of a conventional door handle; the interior handle is equipped with a battery and an electronic control device. Most of the components of conventional doorlatch locks are used.

U.S. Pat. No. 4,820,330 issued Apr. 11, 1989 to Jui-Chang Lin discloses a structure for controlling the dead bolts used in an electric lock. The lock requires the use of a special card which has an invisible coded number on it, but allows the lock to function as a common lock with the electronic part temporarily stopped.

None of the disclosed locks in the prior art have the combined features of being extra strong, remote controlled, security locks, which are not easily overcome or broken by an intruder.

SUMMARY OF THE INVENTION

Accordingly, it is therefore an object of this invention to provide a strong security door lock for a house or building which is operated by remote control.

It is object of this invention to provide a strong security door lock which is installed in a wall adjacent to a door.

It is another object of this invention to provide for manual operation of the remote control security door lock.

It is yet another object of this invention to provide a sensor for determining that a door is closed prior to activating the remote controlled security door lock.

It is another object of this invention to provide a remote controlled security door lock system having a locking mechanism installed in a wall adjacent to a door.

It is further object of this invention to provide an emergency DC power source for operating the security system when a power outage occurs.

These and other objects are accomplished by providing a security door lock comprising means for generating a signal to activate and to deactivate the lock, means connected to the activating signal and positioned adjacent to a door for extending a piston in response to the signal, means attached perpendicular to the piston for moving at least one rod from a door frame into the door, the rod extending from the moving means to the door frame, when the lock is deactivated, and means passing through the moving means for stabilizing the moving means in cooperation with the piston. The moving means comprises the one rod protruding from a first area and another rod protruding from a second area in the direction of the door. The means for extending the piston comprises an actuator. The moving means is attached to piston extending means with angle brackets. The signal generating means comprises means for transmitting a coded signal, means for receiving and decoding the coded signal, means for generating the lock activating signal in response to the decoded signal when the door is closed. The signal generating means comprises a remote control transmitter. The lock comprises means for sensing the door being closed before allowing the piston extending means to be activated. The lock comprises a lever means attached to a sleeve through which the stabilizing means passes for manually locking and unlocking the door lock, one end of the sleeve being attached to the moving means.

Another object of this invention is to provide a security door lock system comprising a remote control transmitter for generating a coded signal, receiver means for decoding the coded signal from the transmitter, means for sensing that a door is closed, means connected to the receiving means and the closed door sensing means for generating a lock control signal and an unlock control signal, actuator means connected to the lock control signal generating means for extending a piston in response to the lock control signal. A rod holder bar attached approximately perpendicular to the piston for moving at least one rod from a door frame into the door, the rod being retracted and extending from the rod holder bar to the door frame when the receiver receives and decodes the unlock control signal, and a horizontal bar passing through the rod holder bar for stabilizing the rod holder bar, the horizontal bar being positioned a predetermined distance away from the attachment of the rod holder bar to the piston. The rod holder bar comprises the one rod protruding from a first end area of the holder bar to within the door frame and another rod protruding from a second end area to within the door frame. The rod holder bar attaches to the piston by angle brackets. The lock system comprises a lever means attached to a sleeve through which the horizontal stabilizing bar passes for manually locking and unlocking the door lock, one end of the sleeve being attached to the rod holder bar.

Still another object of this invention includes a security method of providing a door lock comprising the steps of generating a signal to activate and to deactivate the door lock, extending a piston means toward a door in response to the activating signal, the piston means being positioned in an enclosure adjacent to the door, attaching a holder bar means approximately perpendicular to an end of the piston, extending at least one rod from the holder bar means into the door frame, moving the rod from the door frame into the door, when the piston means is extended, and stabilizing the holder bar by passing through the holder bar a horizontal bar and perpendicular thereto securely attached at each end of the enclosure. The step of generating signals to activate and to deactivate the door lock comprises the steps of generating a coded signal with a remote control transmitter, receiving the coded signal in means for decoding the coded signal, determining the door is closed with sensor means positioned at the door frame prior to providing the activating signal to the piston means. The step of extending at least one rod from the holder bar means comprises the step of extending a second rod from the holder bar means, the rods being spaced apart a predetermined distance. The method comprises the step of providing a door sensor to determine the door is closed before allowing the piston means to be activated. The method comprises the step of manually locking and unlocking the door lock by providing a lever attached to a sleeve which slides along the stabilizing horizontal bar, one end of the sleeve being attached to the holder bar means.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
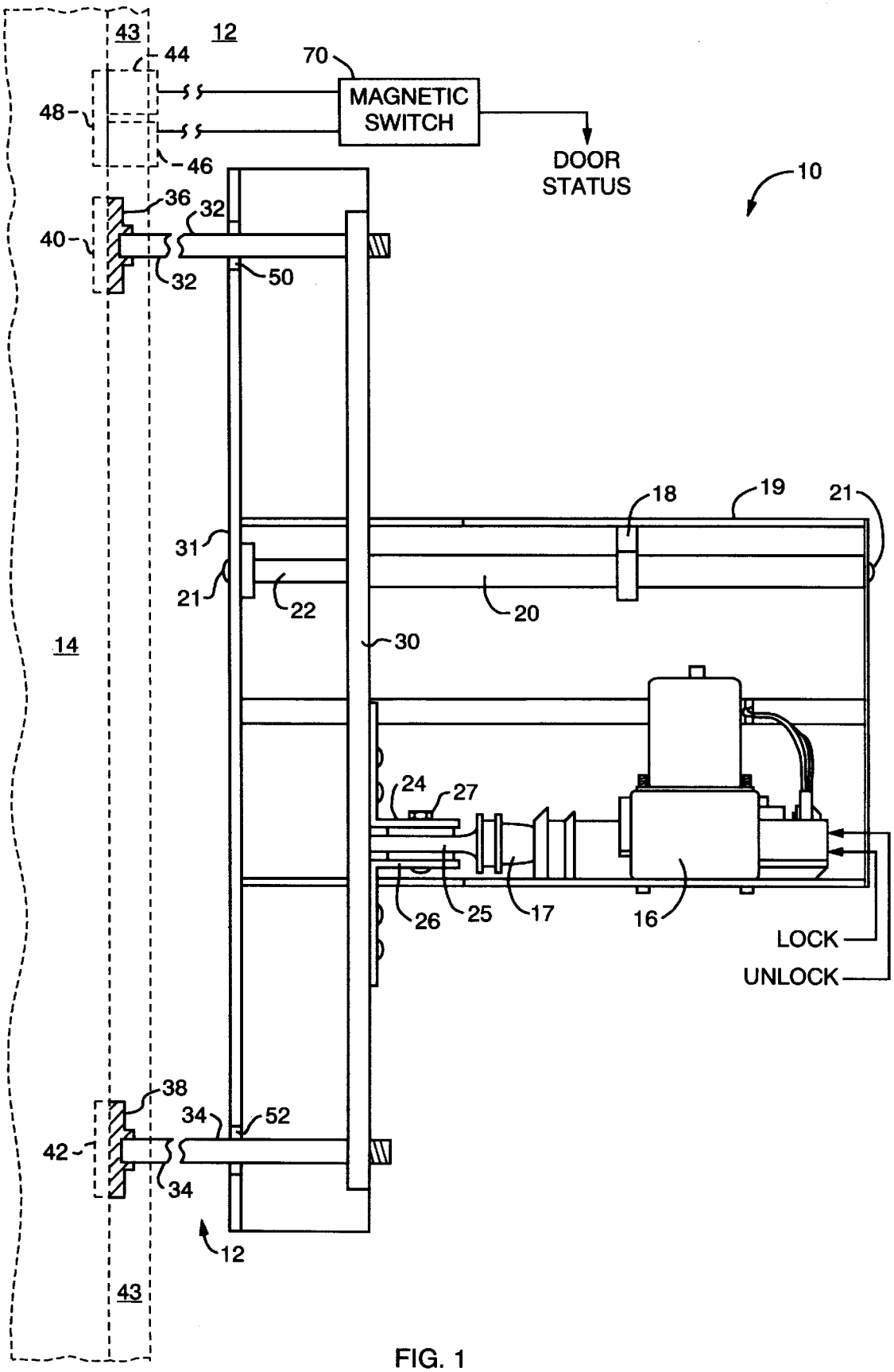
FIG. 1 is a side elevational view of the invention in an unlocked state with a side cover removed positioned in a wall adjacent.

Referring to FIG. 1 a side elevational view of an invention of an electrically operated, strong, security lock 10 is shown in an unlocked state installed in a wall 12 adjacent to a door 14 and a door frame 43. The security lock 10 comprises an enclosure 19 typically made of aluminum or plastic having attached therein an actuator 16. Extending from one side of the actuator 16 is a piston 17 which has a piston extension 25 extending away from the actuator 16. First ends of right angle brackets 24, 26 attach to opposite sides of the piston extension 25 by means of a bolt and nut 27. The second ends of the right angle brackets 24, 26 attach to a rod holder bar 30 which is positioned perpendicular to the piston extension 25.

Two rods 32, 34 extend from opposite ends of the rod holder bar 30 and protrude into jamb plates 36, 38 which are installed in the door frame 43 at the appropriate locations to receive rods 32, 34. The rods 32, 34 screw into threaded holes at the opposite ends of the rod holder bar 30. The rods 32 and 34 extend through holes 50, 52 of an end panel 31 of enclosure 19.

Figure 2:
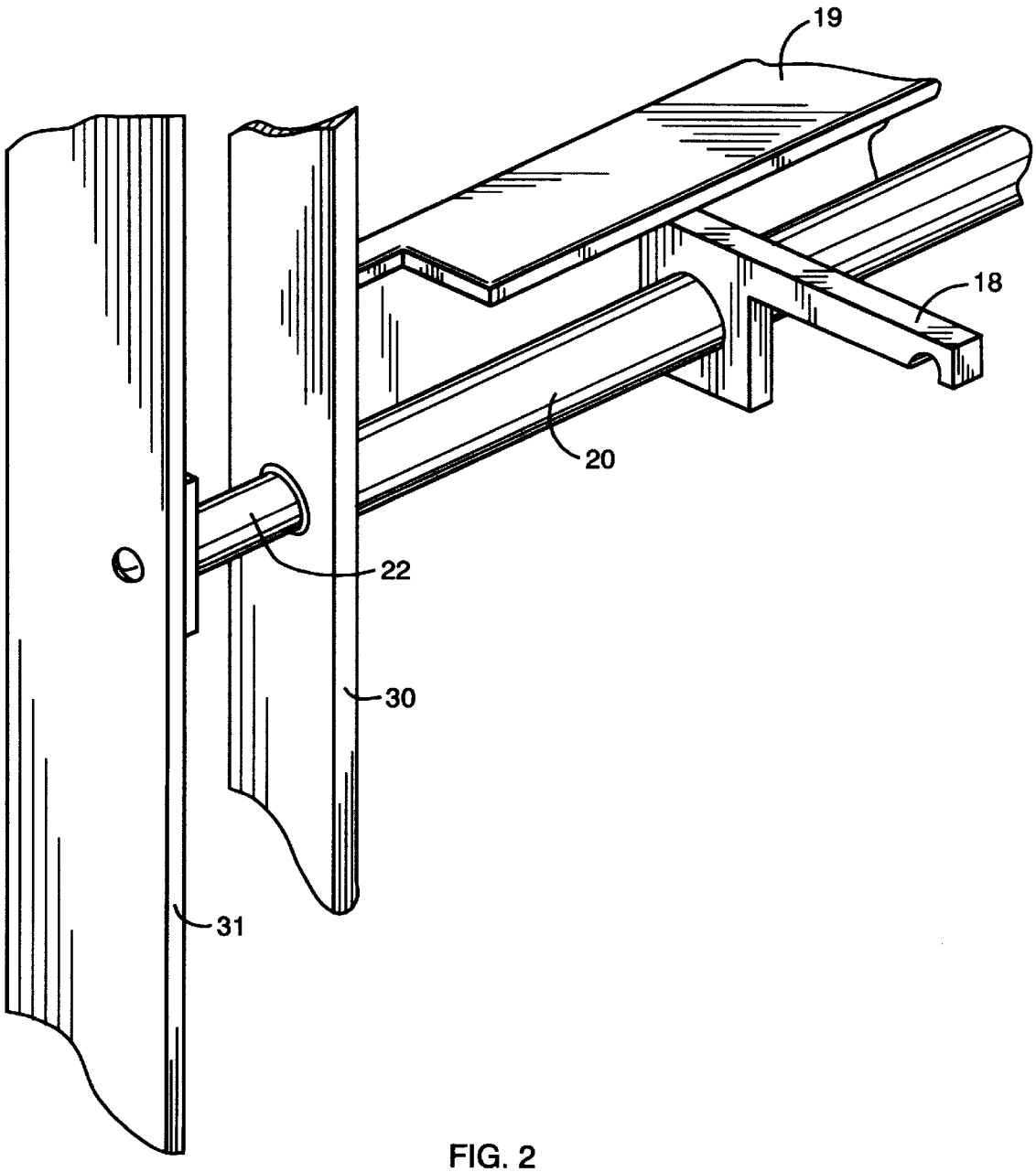
FIG. 2 is a perspective view of a lever for manually unlocking the switch and shows a stabilizer bar protruding through a lower portion of the lever.

Referring now to FIG. 1 and FIG. 2 a stabilizer bar 22 is positioned across the upper portion of the enclosure 19 above the actuator 16. The stabilizer bar 22 is attached by screws or bolts 21 between the right side of the enclosure 19 and the left side comprising end panel 31. A sleeve 20 surrounds the stabilizer bar 22 whereby one end of the sleeve 20 is attached to the rod holder bar 30 by a bead of weld. A lever 18 comprises the sleeve 20 passing through it with the handle portion of the lever 18 extending away from the sleeve 20 and perpendicular to it. The lever 18 is secured to the sleeve 20 by a bead of weld whereby moving the lever 18 towards the door 14 causes the rods 32, 34 to extend beyond the door frame 43 and into a door 14 when it is closed. The actuator 16 performs the same function of moving the rods 32, 34 which are attached to the rod holder bar 30 into the door 14 to lock it, when the actuator 16 receives a lock or activate signal from a receiver 80.

Figure 3:
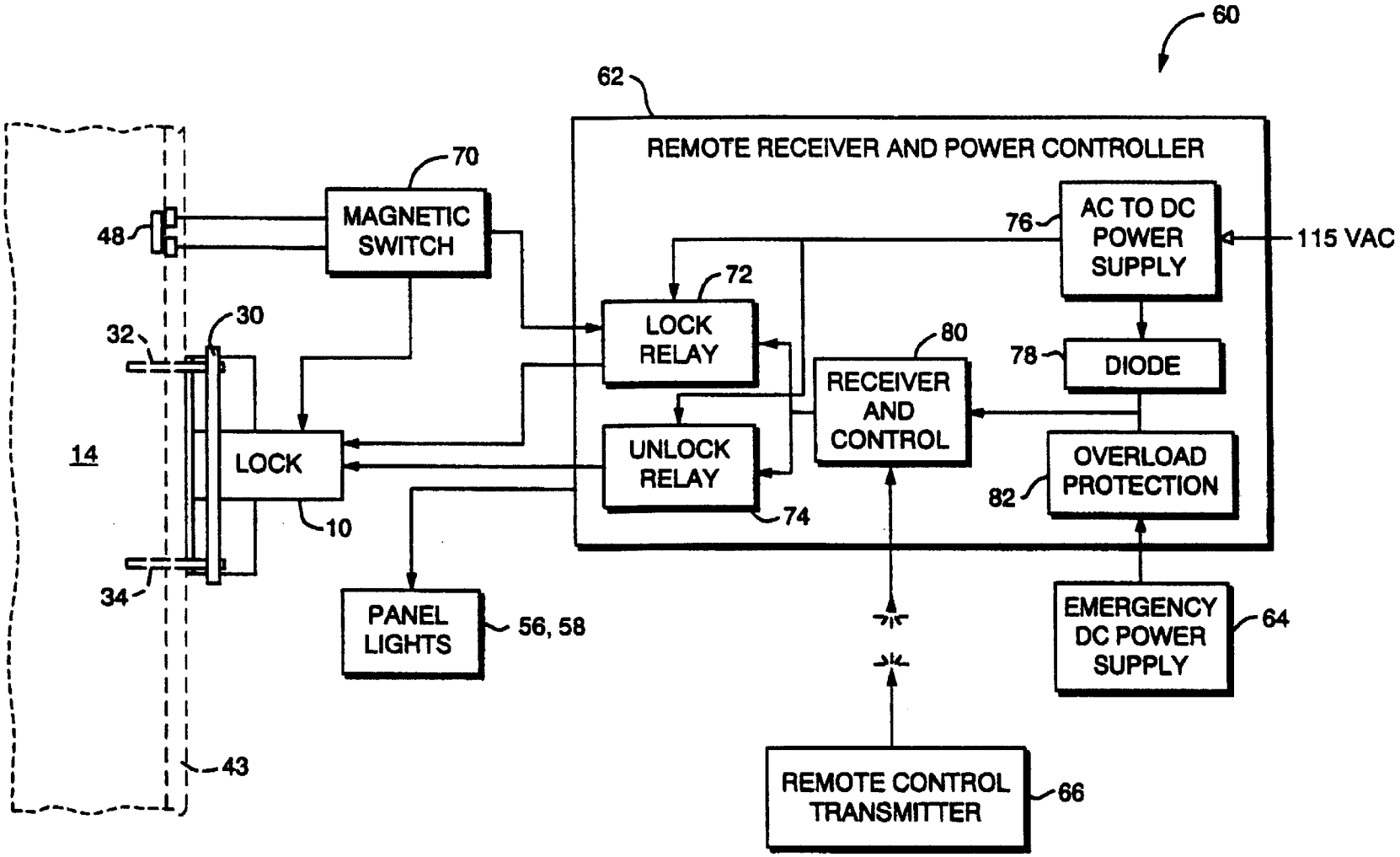
FIG. 3 is a system block diagram of a security door lock system showing the functional elements and their interconnections.

Referring to FIG. 3, a block diagram of a security door lock system 60 is shown comprising the lock 10 and other elements of the system which include a remote receiver and power controller 62, emergency DC power supply 64, remote control transmitter 66, wall panel lights 56, 58, and magnetic switch 70. The remote receiver and power controller 62 comprises a lock relay 72, an unlock relay 74, an AC to DC power supply 76, a diode 78, a receiver and control 80, and an overload protection 82.

The user of the security system 60 generally locks and unlocks the door 14 using the remote control transmitter 66, which may be embodied by a commonly available transmitter having four buttons as used with automobile door locks which provides for locking all doors, opening only a specific door, or turning on a light. The signal from the remote control transmitter 66 is received by the receiver and control 80 and decoded to open the lock 10, close the lock 10, and open or close selected other locks which may be installed for other doors of the house or building.

The magnetic switch 70 determines if the door is closed, prior to activating the remote control security lock 10. If it is closed, a signal is sent from the lock relay 72 to the lock 10 and from the magnetic switch 70 to the lock 10 wherein the actuator 16 is activated and moves the rods 32, 34 into the door 14, thereby locking the door 14.

Two magnetic sensors 44, 46 are positioned in the door frame 43 and a shorting plate 48 is installed opposite the magnetic sensors 44, 46 in the door 14. The magnetic switch 70 may be embodied by Model No. CKMPS9WGW manufactured by Sager Electronics of Waltham, Mass.

Emergency DC power is provided by a hand held emergency DC power supply 64 comprising eight (8) AA batteries commonly available from Radio Shack. This power supply enables operation of the electronic lock 10 when there is a primary power outage. The 12 volt power supply plugs into a receptacle at the remote receiver and power controller 62. The receptacle is wired to a common overload protection circuit 82.

The AC to DC power supply provides 12V DC to the system and is a commercial off-the-shelf (COTS) unit which may be embodied by model 3AMP13.8VDC, manufactured by Tandy Company of Fortworth, Tex. The receiver and control 80 decodes signals from the remote control transmitter 6G and generates signals for the lock relay 72 and unlock relay 74. When a lock relay signal is generated, the lock relay 72 becomes energized and sends a pair of signals to the lock 10. When an unlock relay signal is generated, the unlock relay 74 becomes energized and sends a pair of unlock signals to the lock 10. The lock relay 72 and unlock relay 74 may be embodied by model AROHL2HPCD12V, manufactured by Sager Electronics of Waltham, Mass. The receiver and control 80 may be embodied by model 725T manufactured by Directed Electronics, Inc. of Vista, Calif. Although specific parts have been described for implementing the preferred embodiment, one of ordinary skill in the art will recognize that other equivalent parts may also be used to implement said embodiment.

Figure 4:
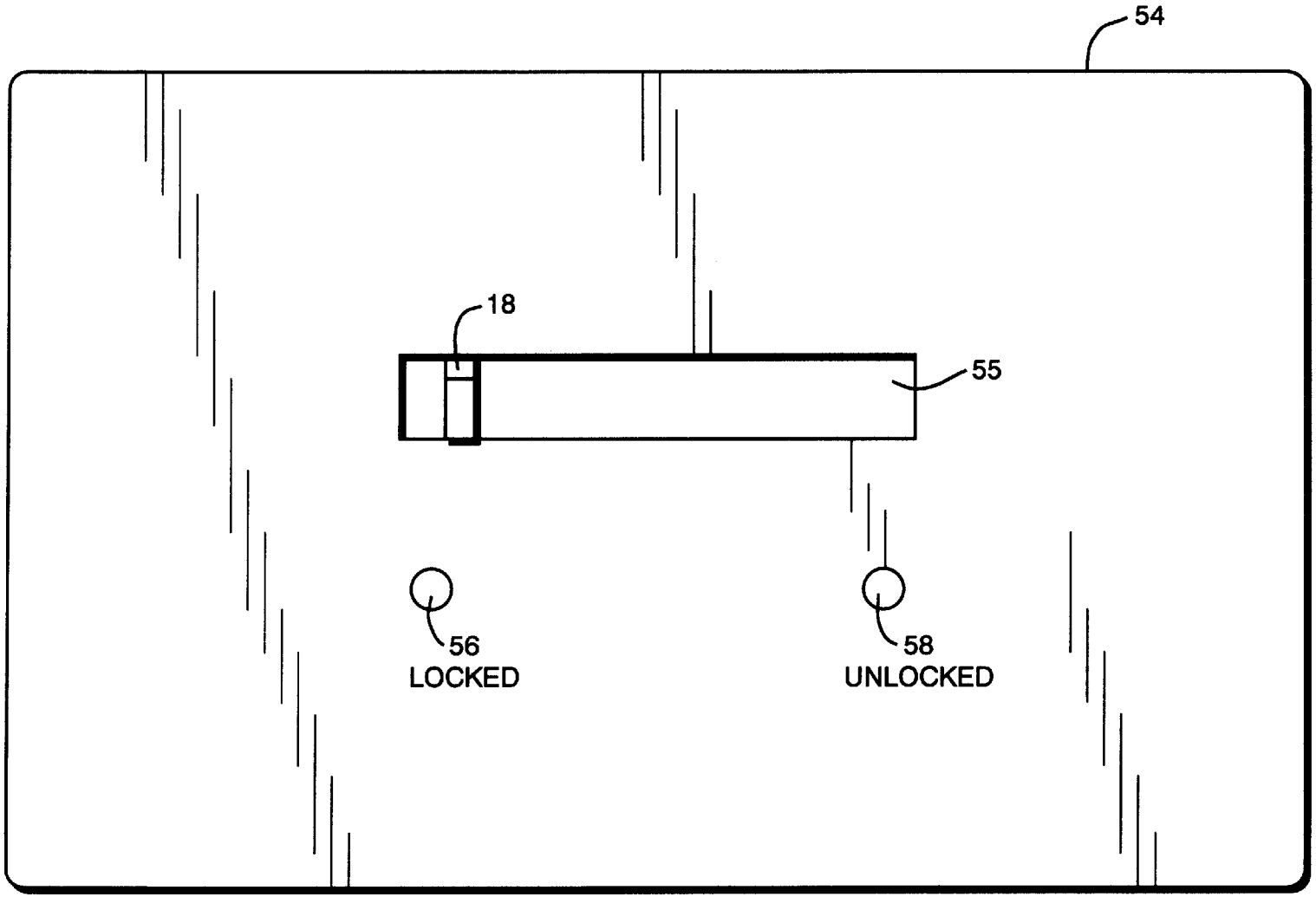
FIG. 4 is a side elevational view of the wall cover for the invention of FIG. 1 showing status lights and a lever for manually controlling the door lock.

Referring to FIG. 4 a wall panel 54 is shown having a rectangular opening 55 through which the lever 18 extends in order to enable the user to manually lock or unlock the security system. Two light emitting diode (LED) indicators 56, 58 are positioned under the opening 55 at each end of opening 55. In FIG. 4 the lever 18 is shown in the locked position, and the LED light 56, located under the lever 18, is green in color. It is turned on when the lever 18 activates a switch to apply voltage to the LED light 56. At the opposite end of the opening 55, the LED light 58 is red in color, and it is turned on when the lever 18 is moved to the UNLOCKED position activating another switch which applies a voltage to LED light 58.

Figure 5:
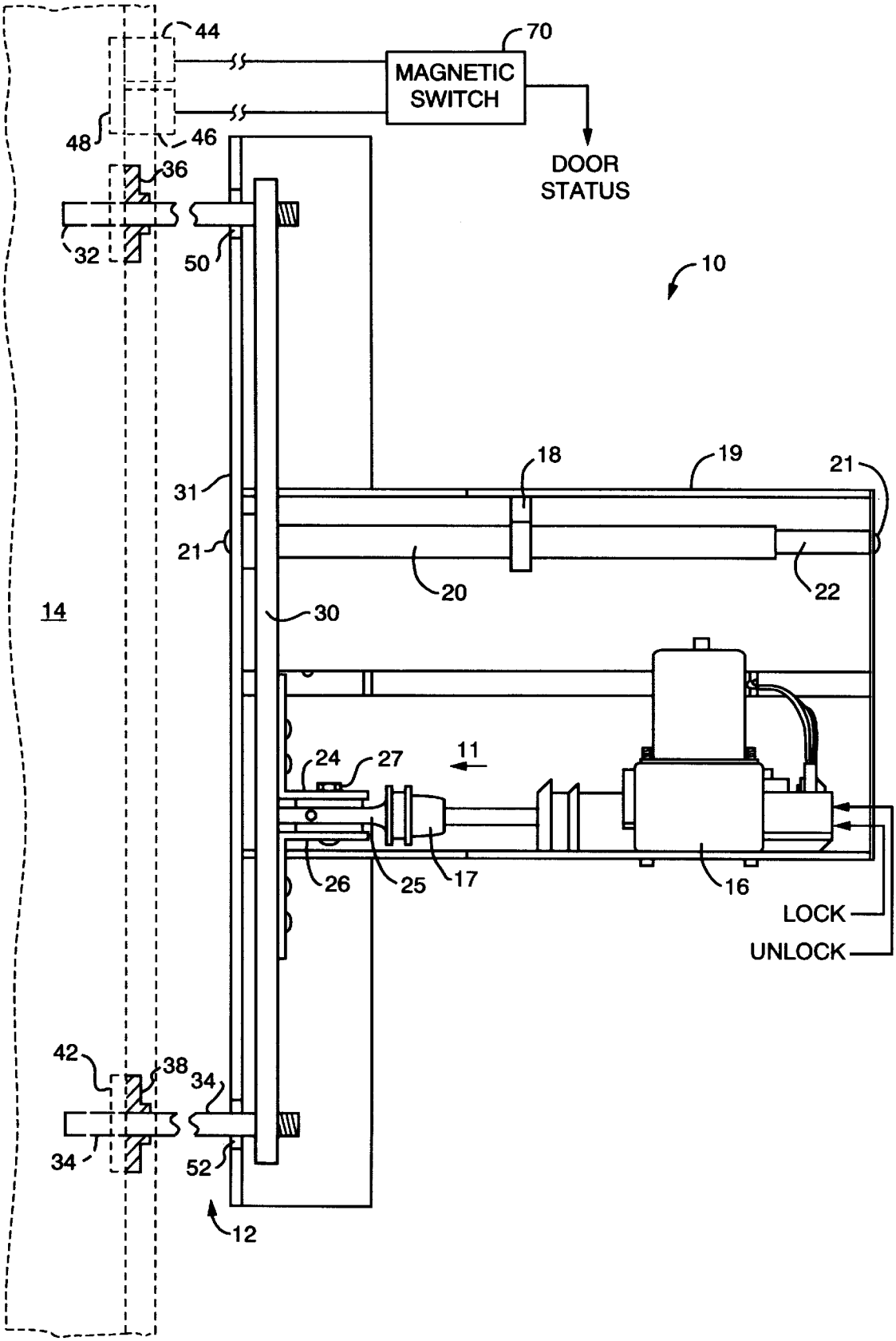
FIG. 5 is a side elevation view of the invention in a locked state with a side cover removed positioned in a wall adjacent to a door.

Referring now to FIG. 3 and FIG. 5, FIG. 5 shows a side elevational view of the lock of FIG. 1 in a locked state as illustrated by the rods 32, 34 extending into the door 14. The actuator 16 receives a signal from the lock relay 72 causing the piston 17 and the piston extension 25 to move away from the actuator 16 in the direction shown by the arrow 11. The rod holder bar 30 likewise is moved in the same direction causing the rods 32, 34 on opposite ends to move out of the door frame 43 and into the door 14.

Figure 6:
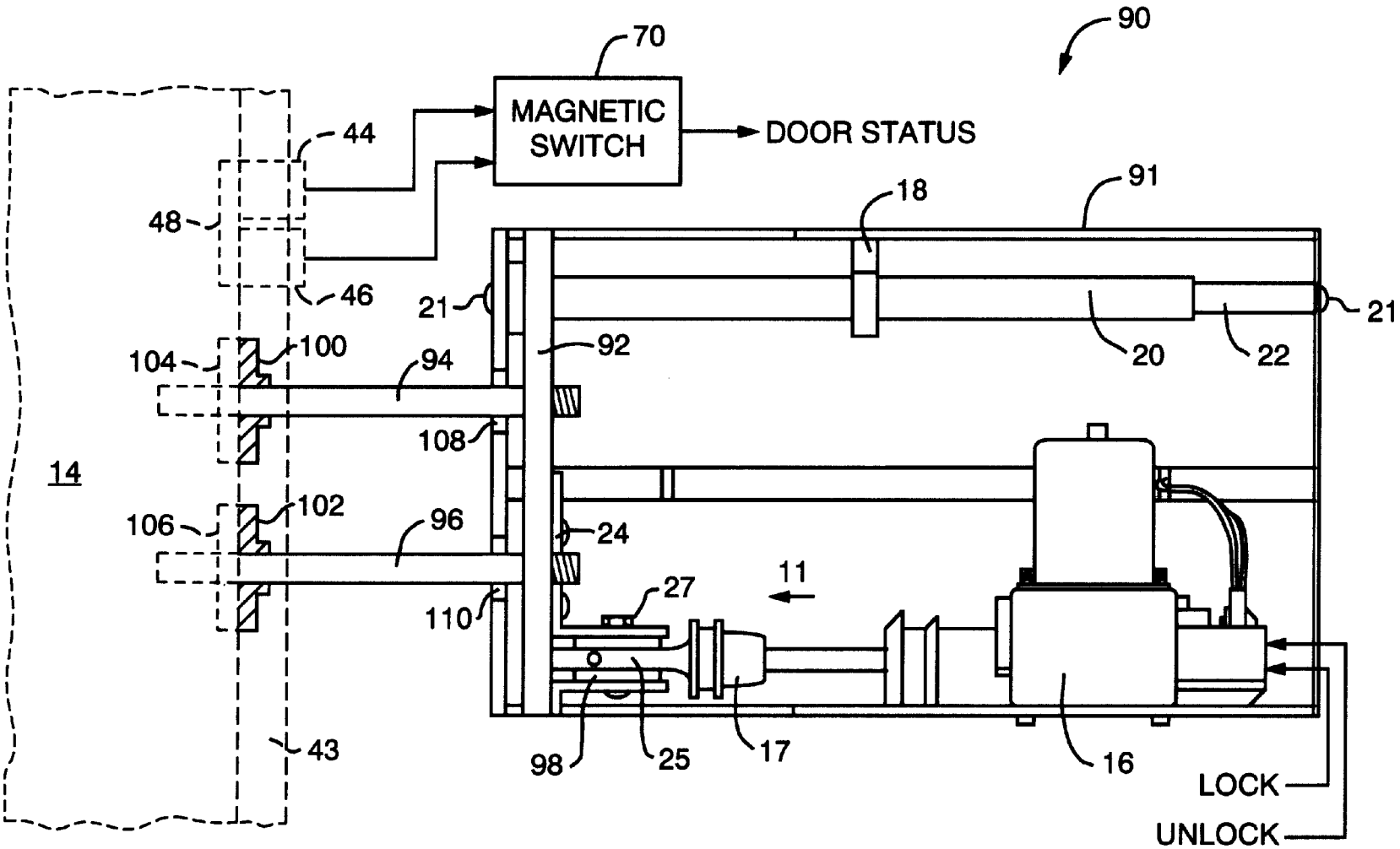
FIG. 6 is a side elevational view of an alternate embodiment of the invention with a side cover removed showing an arrangement of the locking rods close together for use where less space is available in a door or a wall.

Referring now to FIG. 6, a side elevational view of an alternate embodiment of the lock of FIG. 5 is shown with a side cover removed for use with doors having a design not suitable for the spacing of rods 32, 34 of FIG. 5. In this embodiment, the lock 90 comprises the enclosure 91, actuator 16, piston 17, piston extension 25, stabilizer bar 22, sleeve 20 and lever 18 which are the same components as those of lock 10 of FIG. 5. However, in this alternate embodiment the rod holder bar 92 is reduced in height to a maximum height to fit within the enclosure 91. The rods 94, 96 are positioned relatively close to each other near the center of the rod holder bar 92 into which they are secured, and the rod holder bar 92 is attached to the piston extension 25 by right angle brackets 24 and 98. The lock 90 is shown in the activated or locked state whereby the rods 94, 96 protrude into the door 14.

Still referring to FIG. 6, the rods 94, 96 protrude into jamb plates 100, 102 which are installed in the door frame 43 positioned at the appropriate locations to receive rods 94, 96. Opposite the jamb plates 100, 102 are door plates 104, 106 which guide the rods 94, 96 into the door 14 thereby securely locking the door 14.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by letters patent of the United States is:

1. A security door lock for mounting inside a wall comprising:

means for generating a signal to activate and to deactivate said door lock;

means, connected to said signal generating means for extending a piston a predetermined distance in response to said activate signal;

means attached perpendicular to said piston for moving at least one rod said predetermined distance from a first position to a second position when activated, said rod returning to said first position when said lock receives said signal to deactivate;

means, passing through said moving means parallel to said piston, for stabilizing said moving means and said stabilizing means being secured between a first side and an opposite second side of said door lock.

2. The security door lock as listed in claim 1 wherein said moving means comprises said one rod protruding from a first area and in parallel with another rod protruding from a second area.

3. The security door lock as recited in claim 1 wherein said means for extending said piston comprises an actuator.

4. The security door lock as recited in claim 1 wherein said moving means is attached to said piston with angle brackets.

5. The security door lock as recited in claim 1 wherein said signal generating means comprises:

means for transmitting a coded signal;

means for receiving and decoding said coded signal;

means for generating said lock activating signal in response to said decoded signal when said door is closed.

6. The security door lock as recited in claim 1 wherein said signal generating means comprises a remote control transmitter.

7. The security door lock as recited in claim 1 wherein said lock comprises means for sensing said door being closed before allowing said piston extending means to be activated.

8. The security door lock as recited in claim 1 wherein, said lock comprises means, attached to a sleeve through which said stabilizing means passes, for manually locking and unlocking said door lock, one end of said sleeve being attached to said moving means.

9. A security door lock system for mounting inside a wall adjacent to a door and a door frame comprising:

a remote control transmitter for generating a coded signal;

receiver means for decoding said coded signal from said transmitter;

means for sensing that said door is closed;

means connected to said receiver means and said closed door sensing means for generating a lock control signal and an unlock control signal;

actuator means connected to said lock control signal generating means for extending a piston a predetermined distance in response to said lock control signal;

a rod holder bar attached approximately perpendicular to said piston for moving at least one rod said predetermined distance from a position in said door frame to a position inside said door in response to said actuator means receiving said lock signal, said at least one rod being retracted to said Position in said door frame in response to said actuator means receiving said unlock control signal;

a horizontal bar passing through said rod holder bar parallel to said piston for stabilizing said rod holder bar, said horizontal bar being positioned a predetermined distance away from said attachment of said rod holder bar to said piston; and said horizontal bar being secured between a first side and an opposite second side of said lock system.

10. The security door lock system as recited in claim 9 wherein said rod holder bar comprises said one rod protruding from a first end area of said holder bar and another rod protruding from a second end area.

11. The security door lock system as recited in claim 9 wherein said rod holder bar attaches to said piston by angle brackets.

12. The security door lock system as recited in claim 9 wherein said lock system comprises means attached to a sleeve through which said horizontal stabilizing bar passes for manually locking and unlocking said door lock system, one end of said sleeve being attached to said rod holder bar.

13. The security door lock system as recited in claim 9 wherein said system comprises an AC power source and means for providing DC power to said system when the AC power source is unavailable.

14. A method of providing a security door lock for use in a wall adjacent to a door and a door frame comprising the steps of:

generating a signal to activate and a signal to deactivate said door lock;

electrically extending a piston attached to an actuator toward a door in response to said activating signal, said piston being positioned in an enclosure adjacent to said door;

attaching a holder bar approximately perpendicular to an end of said piston;

extending at least one rod from said holder bar into a door frame;

moving said rod from said door frame into said door, when said piston is extended; and stabilizing said holder bar by passing through said holder bar a horizontal bar and perpendicular thereto, said horizontal bar being securely attached at each end of said enclosure.

15. The method as recited in claim 14 wherein said step of generating a signal to activate and a signal to deactivate said door lock comprises the steps of:

generating a coded signal with a remote control transmitter;

receiving said coded signal in means for decoding said coded signal;

determining said door is closed with sensor means positioned at said door frame prior to providing said activating signal to said piston.

16. The method as recited in claim 14 wherein said step of extending at least one rod from said holder bar comprises the step of extending a second rod from said holder bar, said rods being spaced apart a predetermined distance.

17. The method as recited in claim 14 wherein said method comprises the step of providing a door sensor to determine said door is closed before allowing said piston to be activated.

18. The method as recited in claim 14 where said method comprises the step of manually locking and unlocking said door lock by providing a lever attached to a sleeve which slides along said stabilizing horizontal bar, one end of said sleeve being attached to said holder bar.

* * * * *